US008213634B1

(12) United States Patent
Daniel

(10) Patent No.: US 8,213,634 B1
(45) Date of Patent: Jul. 3, 2012

(54) MODULAR AND SCALABLE DIRECTIONAL AUDIO ARRAY WITH NOVEL FILTERING

(75) Inventor: Thomas Martin Daniel, Norwalk, CT (US)

(73) Assignee: Daniel Technology, Inc., Norwalk, CT (US)

( * ) Notice: Subject to any disclaimer, the term of this patent is extended or adjusted under 35 U.S.C. 154(b) by 52 days.

(21) Appl. No.: 12/880,863

(22) Filed: Sep. 13, 2010

Related U.S. Application Data

(63) Continuation of application No. 11/462,978, filed on Aug. 7, 2006, now abandoned.

(51) Int. Cl.
*H04R 15/00* (2006.01)

(52) U.S. Cl. ..... 381/92; 381/91; 381/122

(58) Field of Classification Search ..... 381/91, 381/92, 87, 122, 111, 182, 355, 356, 312, 381/313, 94.1–94.4, 56, 57, 150
See application file for complete search history.

(56) References Cited

U.S. PATENT DOCUMENTS

| | | | | |
|---|---|---|---|---|
| 5,471,538 | A * | 11/1995 | Sasaki et al. | 381/92 |
| 6,600,824 | B1 * | 7/2003 | Matsuo | 381/92 |
| 7,092,539 | B2 * | 8/2006 | Sheplak et al. | 381/114 |
| 7,764,801 | B2 | 7/2010 | Soede et al. | |
| 2005/0169487 | A1 | 8/2005 | Soede et al. | |
| 2007/0025562 | A1 * | 2/2007 | Zalewski et al. | 381/92 |

OTHER PUBLICATIONS

Arnold, et al.; "A Directional Acoustic Array Using Silicon Micromachined Piezoresistive Microphones"; JASA, 113, Jan. 2003; 10 pages.

* cited by examiner

*Primary Examiner* — Xu Mei
*Assistant Examiner* — Lun-See Lao
(74) *Attorney, Agent, or Firm* — St. Onge Steward Johnston & Reens LLC

(57) ABSTRACT

A directional sensor array system generally for remote audio collection applications that is modular, scalable, and robust with the modules assembled in layers. The invention can alternatively employ sensors other than microphones, such as ultrasonic transducers and accelerometers. In the preferred embodiment, the sensors are mounted on tiles, each of which performs its own local beamforming using a low-impedance resistive summation technique. The tiles are constructed in a layered, sandwiched fashion and incorporate integral protection from wind, sand, dust, moisture, radio frequency noise, vibration, ambient acoustic noise, and directional acoustic noise, as well as provide inter-sensor isolation. Multiple tiles can be joined together physically and electrically. When joined, a secondary parallel beamforming is performed on the bus using electrical summation. Due to the techniques employed, large scale arrays are feasible at low power consumption—for example, an array of 400 microphone elements can be powered for over 6 hours by a single 9 volt battery.

10 Claims, 7 Drawing Sheets

MODULAR AND SCALABLE DIRECTIONAL AUDIO ARRAY WITH NOVEL FILTERING

CROSS-REFERENCE TO RELATED APPLICATIONS

The present application is a continuation of U.S. patent application Ser. No. 11/462,978, filed Aug. 7, 2006 now abandoned, and the content of which is incorporated herein by reference.

FIELD OF THE INVENTION

The present invention generally relates to directional audio systems and in particular to the design, construction and processing (i.e. filtering and rendering) of robust, modular, and scalable directional audio systems.

BACKGROUND OF THE INVENTION

General governmental, as well as consumer, applications for remote audio collection require operation in many different, challenging environments such as indoor, outdoor, automobile and portable (body-carried or -worn), which experience a variety of bothersome conditions, such as wind, sand, dust, precipitation, radio frequency (RF) interference (e.g. from mobile communications), extreme temperatures, and acoustic noises. Limited scenarios have been addressed by prior devices, such as hands-free directional microphones for automobiles and small microphone arrays for computer workstations and hearing aids. Significant problems remain for prior devices to function effectively in the more general case. Prior devices also can not be easily scaled between small and large configurations for greater effectiveness, without significant impact on complexity, noise performance, power consumption, or architecture.

Directional microphones by definition selectively receive the sounds situated directly in-line with their (on-axis) look direction and have the ability to cancel or reject sounds coming from other (off-axis) directions. A microphone array can be used as a directional microphone system and consists of, in its simplest form, a plurality of microphones with appropriate processing of the audio signals from the microphones so as to accomplish the formation of a directional pick-up pattern. A traditional simple broadside microphone array is shown in FIG. 1.

Microphone arrays of this type, which use direct summation of the signals from the array of microphones, produce a directivity (i.e. width of the mainlobe of the pick-up pattern) which is dependent on the frequency. The directivity generally depends on the effective length of the array and the acoustic wavelength at the inspected frequency. Therefore, at low frequencies a lesser degree of directivity is achieved and the directivity increases with the frequency.

The lowest wavelength at which a microphone array can provide a certain degree of directivity is dependent on the overall length of the array. The highest frequency at which the pick-up pattern does not exhibit spatial aliasing (i.e. which causes loss of directional characteristics at high frequencies) depends on the distance between the microphones in the array.

Prior directional microphone array devices have been implemented in both analog and digital hardware circuitry, as well as in software (with appropriate audio capture hardware to collect and digitize the sound). Prior all-analog hardware implementations have been based on high-impedance resistive summation circuits. High-impedance summing circuits inherently have poor noise immunity, which in turn limits the maximum number of microphone elements that can be employed effectively as well as makes them very susceptible to electromagnetic interference.

Prior digital devices are generally complex, even for small systems such as those used in hearing aids. If many channels are digitized, then they quickly become impacted by the additional size (along with associated weight) and power requirements. These deficiencies result from the fact that in digital microphone array systems, each microphone channel must be digitized separately and synchronized with all other channels, carried to a central processor for beamforming and other filtering, and then reconverted to analog (sound) for the user to hear. Therefore, digital implementations suffer from a scaling problem in size, weight, power consumption, and cost as the array size increases to hundreds or thousands of microphones. As the number of channels increases, the amount of digital noise also increases. Additional shielding or other techniques are required, which further increase the weight and/or size. Furthermore, in traditional digital microphone array systems there is a central processor which performs the beamforming. For any given model digital processor, there is a maximum amount of data that can enter or exit the processor at any given time as well as a maximum number of instructions the processor can execute at any given time. Therefore, any given model digital processor has an inherent limit to how many audio channels it can accommodate.

The limit on the number of audio channels for a given model processor is a significant issue. For a microphone array to address most general cases, many microphone channels are required. As a practical matter, in challenging environmental scenarios with strong directional noise sources or diffuse noise, many microphone elements are needed if sidelobes of the pickup pattern are to be kept to a minimum while maintaining a narrow mainlobe (so as to reduce the pickup of off-axis interferences). This is the limitation inherent in microphone arrays used as hearing aids, for instance—all of the in-ear and on-ear implementations are inherently limited by how much weight, size, and heat can be accommodated by the wearer and therefore, even with sophisticated digital processing, digital hearing aid microphone arrays have limited directionality and sidelobe attenuation.

Prior devices have been constructed from electret or other types of microphones that have excellent sensitivities and do not require the type of phantom power used by studio microphones, but these microphones also have limited ranges of operation over temperature extremes, such as the military might encounter in hot deserts.

Microphone elements other than electrets have been tried in the prior art. Arnold, et al (JASA, 113, January 2003) published results of their construction of a low impedance, silicon (Micro-Electro-Mechanical Systems or MEMS based) element microphone array which mounted the microphones and centralized digital processor on a printed circuit board (PCB). The system by Arnold, et al, was novel in the sense that by using silicon microphone elements they lowered the overall system cost (as the individual microphones are cheaper) and did not have as many cables (because the audio signal was carried in the PCB traces). However, this array processing section was an all-digital implementation, so it did not take advantage of the microphones' analog electrical properties, nor did it provide for acoustic and vibrational damping, inter-microphone isolation, or wind protection. Being digital, it still inherently suffered from limitations in scalability regarding power consumption, complexity, heat, and weight. The scalability limits due to complexity are because of the inherent limits of any given model digital processor and its data bus. Extra stiffening components also had to be added to the printed circuit board to support its own weight.

Prior devices have incorporated single cables to transport microphone or beamformed audio within the system. Using multiplexing to implement a single cable audio transport within the system is well known in digital applications. However, employing digital multiplexing in large digital arrays is extremely difficult because of the complexity, cost, power requirements, distance limitations, and timing requirements of the digital circuitry. Digital multiplexing based implementations are not as versatile since each implementation must be designed for a specific (maximum) size array.

The single cable analog implementation described in the application by Soede et al (U.S. patent application Ser. No. 10/943,456, filed Sep. 17, 2004) employs a series of two-node summing networks each followed by a buffer. In their implementation, each stage of the series adds noise along with the signal of the additional microphone and therefore realizes no improvement in signal to noise ratio as more elements are added. This did reduce the power consumption and complexity of the device compared to all-digital implementations, but the solution created a scalability problem related to noise due to the use of the serial high impedance summing—the more stages, the more noise. This is not a concern for their targeted application, which was hearing aids, but becomes a limiting issue when scaling up to larger systems to address the general case.

The present inventor has in the past worked on a commercial product (conceived and implemented by the inventor along with other colleagues) that involved interconnecting multiple high impedance analog beamformers in a master/slave (hub/spoke) configuration. Although this particular implementation was significantly better than previous devices, it also suffered from noise susceptibility to RF interference, summing and other noises, as well as temperature restrictions (due to the electret microphones used).

Prior analog and digital devices have employed so called "aperture shading" to modify the pickup (beam) pattern. Rather than simply summing the microphone outputs (which might be individually time-delayed or not, depending on whether or not electronic steering is used), with aperture shading the signals are first multiplied by different gain factors (or weights) before summing. This extra pre-filtering step shades the aperture, allowing the designer to tradeoff beamwidth and sidelobe attenuation. This is analogous to choosing a window shape in 1-D (frequency) filter design. This is an effective technique, however it is a tradeoff and the designer must strike a balance between two desirable characteristics.

A highly directional audio system that can operate in a wide range of environments and be applied to various fixed, portable, and mobile applications needs to be physically and electrically robust, extremely power efficient, economical, inherently scalable, and noise immune while improving on directivity, sidelobe attenuation and audio quality. Previous implementations of analog and digital audio arrays have therefore not been able address all of these concerns simultaneously.

Several objects and advantages of the present invention are:

(a) to allow modular construction of a directional audio array that is highly scalable with no practical limit to the size (i.e. number of microphone elements) in the array;

(b) to provide significantly improved noise immunity compared to previous techniques;

(c) to allow low cost of construction, high reliability, high temperature operation, low overall system weight, and simplicity of operation;

(d) to significantly lower the effective internal system noise even when employing microphones with relatively high individual internal noise so as to receive, amplify, and reproduce low level on-axis sounds at intelligible levels;

(e) to allow integration of microphone elements, windscreen, protection from blowing sand and dust, moisture protection, vibration damping, acoustic shielding and isolation, structural rigidity and beamforming circuitry;

(f) to allow surface mounting of the sensors and all other electronic components for cost efficient automated fabrication;

(g) to allow use of a single cable and bus to serve as the interface to the entire array of modules and allow secondary parallel beamforming of additional modules;

(h) to provide additional off-axis noise rejection above and beyond standard beamforming;

(i) to modify the audio output in such a way as to allow the listener to more easily distinguish between off-axis and on-axis sounds by utilizing a psychoacoustic effect;

(j) to allow the creation of an easily scalable analog pre-beamformer on the front end of an analog or digital audio array system;

(k) to allow the efficient use of a sufficient number of sensors to simultaneously have high gain, high directivity, and high sidelobe attenuation;

(l) to allow the user to easily and immediately determine whether the sound source concerned is situated in the center of the main lobe, which is very important when using microphone arrays with a high degree of directivity;

(m) to allow uniform and non-uniform inter-microphone spacings so that the pick-up pattern can be manipulated by the designer;

(n) to allow the use of omni-directional or uni-directional microphone elements with appropriate mounting to make the pattern less or more directional; and (o) to allow the extension of the low impedance summation and modular beamforming array techniques to include other audio transducers, such as ultrasonic and accelerometer as two examples.

Still further objects and advantages of this invention will become apparent from a consideration of the ensuing description and drawings.

SUMMARY OF THE INVENTION

According to one aspect of the invention, a system and method for a robust, modular and highly scalable directional microphone array is provided. The present invention can be quickly assembled into different sizes and configurations which in turn modify the effective pickup pattern of the device. Arrays with few (20 or fewer) to very many (1000 or more) microphones can be constructed with no impact other than being able to support the physical size and weight as well as supplying sufficient power when assembling very large configurations. Beamforming is performed in a distributed fashion—firstly on each module (also known as a "tile" in the preferred embodiment) independently and then, in the case of multiple tiles, secondly on the electrical connection bus. Due to these and associated characteristics, the invention is inherently scalable from small to large sizes with little negative impact on complexity and power requirements—for example, arrays of up to 400 elements can be powered for over 6 hours by a single 9 volt IEC type 6LR61 battery (i.e. a common consumer market 9 volt battery).

According to another aspect of the invention, a directional microphone that has integral wind, sand, dust, moisture, RF noise, ambient (i.e. non-directional) acoustic noise, and directional acoustic noise protection.

According to another aspect of the invention, unlike the prior art digital processing systems that have many bulky, and (currently) power hungry, hardware components (e.g., transducers and processors), the present invention provides a directional audio system that is embodied in a small number of analog electronic components, is light-weight, is scalable, and has low power consumption due to its construction and use of low impedance summation to form the beamforming circuit.

mon According to another aspect of the invention, a directional microphone system that is light, thin, compact (in standard configurations), and useful in consumer household, commercial office, sporting field, and law enforcement, and military applications is provided.

According to another aspect of the invention, a modular fixed (broadside pattern) directional microphone that can be made electronically steerable with the addition of appropriately designed delay and steering circuitry.

According to another aspect of the invention, a directional microphone system consisting of as few as one tile that has non-uniform inter-microphone spacing, such as spiral, logarithmic, concentric circle, or random arrangement as examples.

According to another aspect of the invention, a modular directional array system of similar design to the invention that employs transducers other than traditional microphones, such as ultrasonic sensors or vibration transducers (accelerometers).

BRIEF DESCRIPTION OF THE DRAWINGS

The figures form a part of the invention disclosure and are used to illustrate a preferred embodiment but not to limit the scope of the claims to that embodiment:

In the following, the invention will be described in more detail with reference to the drawing, where.

DRAWINGS

Reference Numerals

100 Tile Assembly
101 Printed Circuit Board (PCB)
102 Front Rubber Face
103 Punched Holes in Front Face
104 Microphone Element and associated Electronic Circuitry Producing ADF/Summation (Angle Dependent Filtering and Low-Impedance Resistive Summation)
105 Components for Power Management of Microphone Elements
106 Bus Connection Pads
107 Fabric Cover
108 Back Rubber Face
109 Mounting Holes
110 Base Unit
111 Output Volume Control
112 Output Jack
113 Battery Compartment
114 Attachment Clip (Optional)
115 Connecting Cable to Base Unit

DETAILED DESCRIPTION OF THE INVENTION

Figure 1:
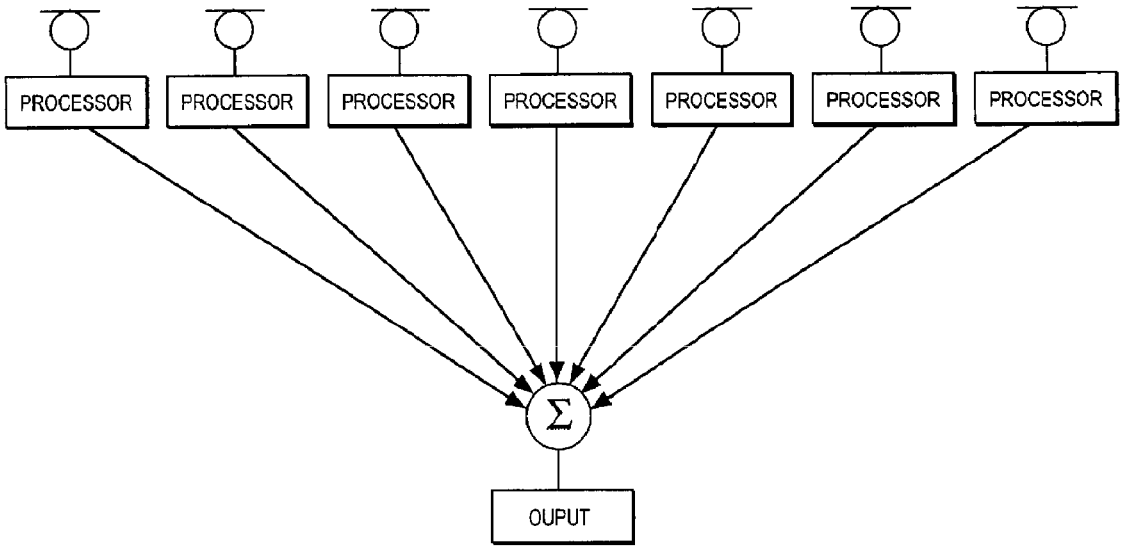
FIG 1 PRIOR ART
FIG. 1 is a traditional prior art broadside directional microphone array.
Figure 2:
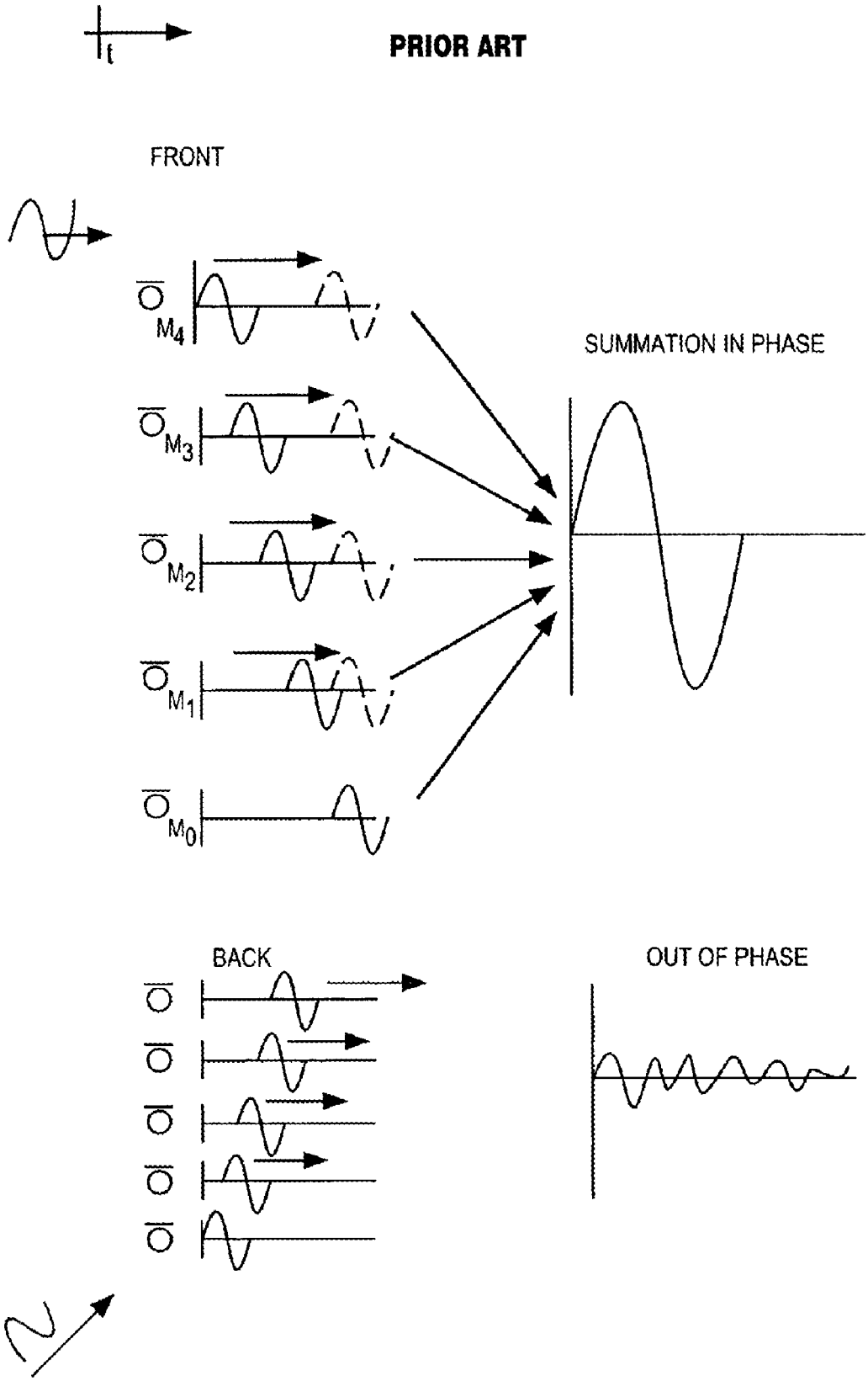
FIG. 2 PRIOR ART
FIG. 2 is a graphical illustration of on-axis (constructive) and off-axis (destructive) summation in a microphone array.
Figure 3:
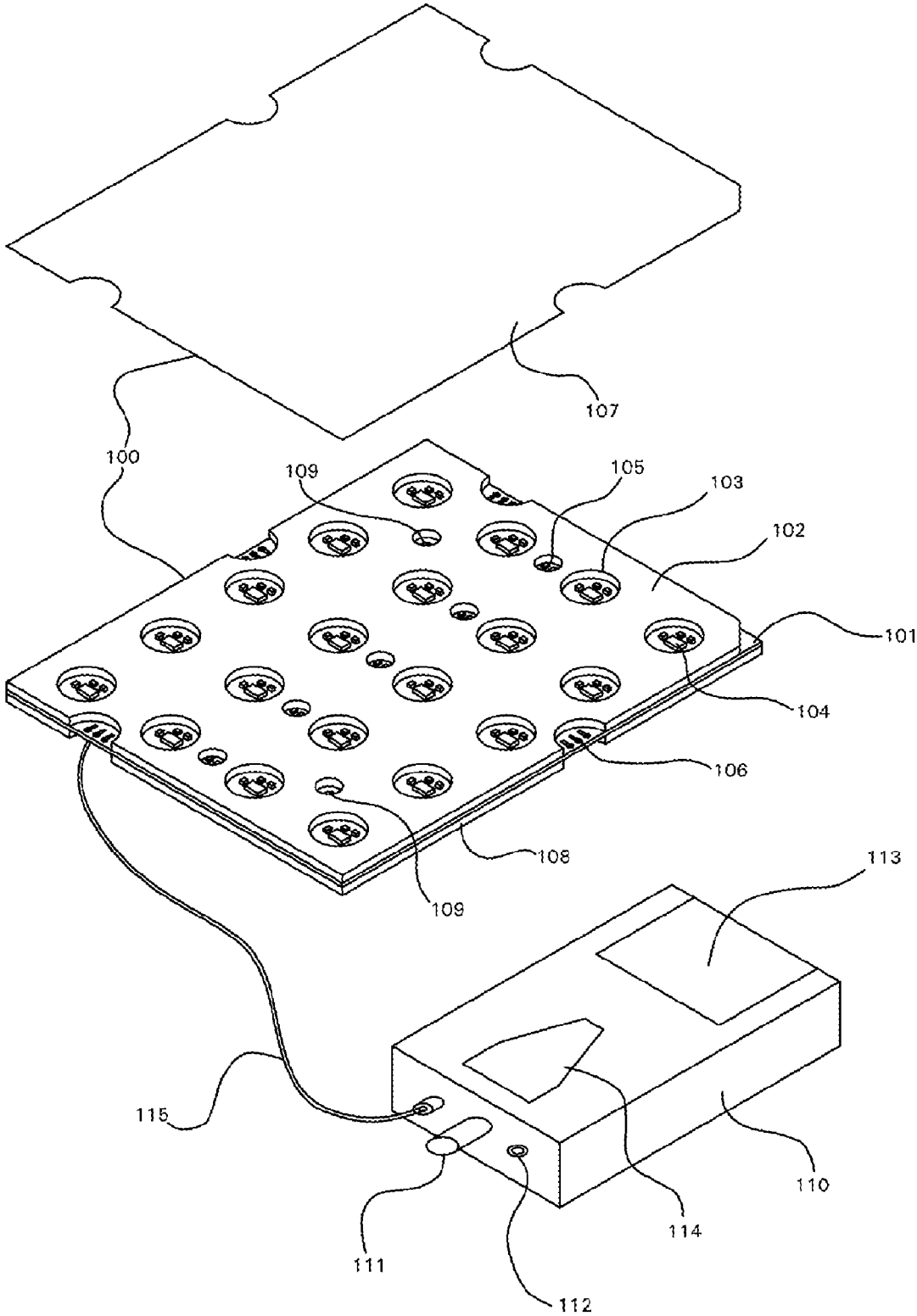
FIG. 3 is an isometric illustration of the preferred embodiment of the invention as a tile.

FIG. 3 is a perspective view of a basic version of the invention. It consists of a single microphone beamforming module (tile), a connecting cable, and a base unit. The tile 100 has a bottom layer consisting of a sheet of sound and vibration absorbent material, such as 30 A durometer neoprene rubber, typically of 3.0 mm thickness. The printed circuit board (PCB) 101 is bonded (adhered) directly on the bottom layer, 108 forming the next layer itself. The PCB 101 is either a single-sided or two-sided board with its bottom side typically being a metal ground plane. Microphones 104 and electronic components 104 are typically mounted on the top side of the PCB 101. The microphones 104 are typically arranged in a 4×5 grid with uniform spacing between all microphones. The distance of the outer microphones from the edge of the PCB 101 is typically such that if additional tiles are abutted to this tile, then the distance from this tile's outer microphones to the outer microphones on the immediately adjacent tile is the same as the distance between the microphones on any one tile. On all four edges of the PCB are electrical connection pads 106 with through holes or fingers. A second sound absorbent sheet 102, such as 70 A durometer neoprene rubber, typically of 3.0 mm thickness (of a different density than the bottom sound absorbent layer) is bonded (adhered) to the PCB 101. Holes have been punched 103 through the sheet so that the microphones 104 and interconnection pads 106 are exposed. In this embodiment the electronic components 103 are also typically exposed. Additional holes 105 have been punched for the placement of power management components which are common to multiple microphone elements. Finally, a sheet of water repellent and wind resistant fabric 107 typically of 0.5 mm thickness is layered on top. Adhesive is applied to the top rubber surface 102 to attach the fabric without occluding the holes containing the microphone elements. The layers are all attached to each other by means of an adhesive. The tile also has several holes 109 that go completely through for mounting the tile to surfaces using bolts, screws, or other fasteners.

Multiple tiles may be connected together using three electrically conductive wires or jumpers that join their corresponding adjacent electrical connection pads 106 together.

The connecting cable 115 is electrically connected between the tile, or any outer tile, if multiple tiles are connected together, and the base unit.

In this embodiment, the base unit 110 is a compact electronic audio amplifier made from PCB mounted electronics housed in a plastic box with the optional belt clip 114, output volume adjustment knob 111, a socket for connecting the output signal 112, and a self contained battery compartment 113.

Figure 6:
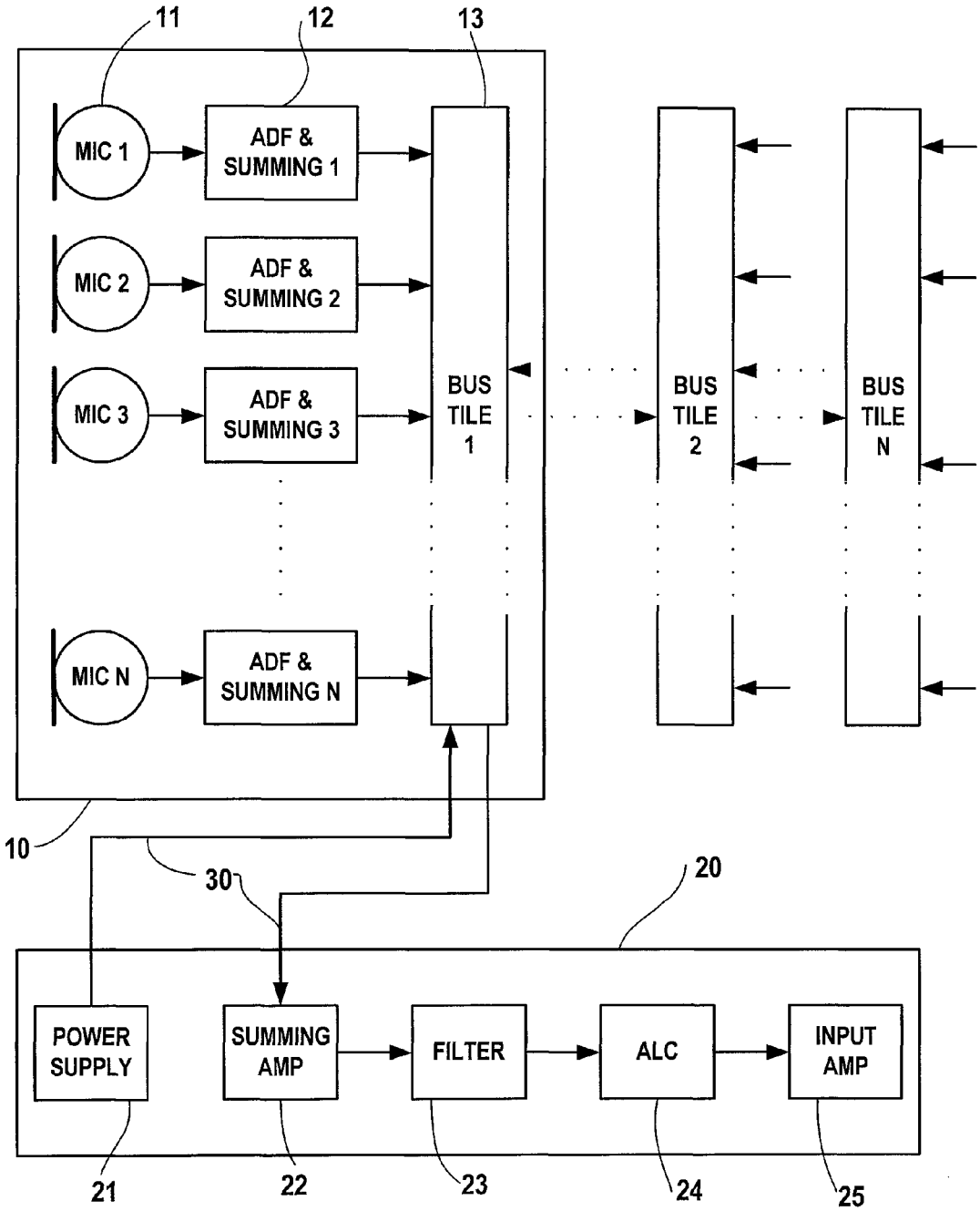
FIG. 6 is a block diagram of the preferred embodiment of the invention including tile, connecting cable, and base unit.

The electrical configuration of this embodiment of the invention is illustrated by means of the block diagram shown in FIG. 6. This figure shows a number of microphones MC110-MC540 which are arranged in a grid pattern on each tile. Each of the microphones is filtered in the Angle Dependent Filtering (ADF)/Summation block which forms the output signal for each modular tile.

If additional tiles are included in the array, then they are interconnected using the three-wire interface exposed interconnection pads FIG. 3 106 found on each tile. The interconnection bus pad interface consists of Power, Ground, and Summed Audio Signal. If multiple tiles are connected together, the interconnection bus also performs a secondary beamforming via direct parallel electrical voltage summation of the individual summed audio signals outputted from each tile and presented on the interface. It should be noted that as more tiles are added to the bus, they act as a mutual parallel shunt element on the audio leg of the bus which lowers the total shunt impedance. This in turn improves noise immunity and the effectiveness of ADF.

Only one interconnection pad of the entire array assembly is connected via an electrical cable 115 to the Base Unit 110.

Figure 4:
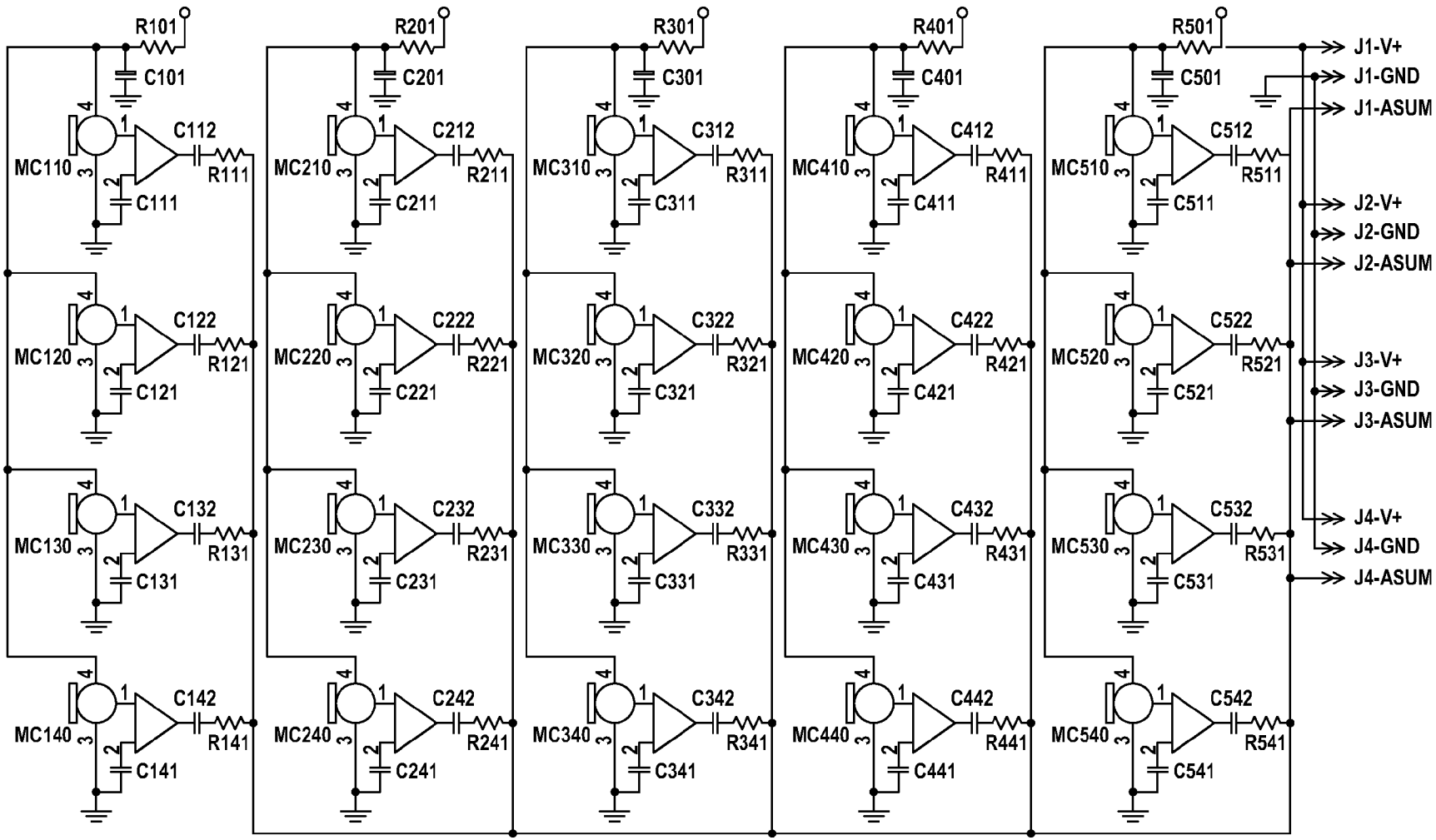
FIG. 4 shows circuitry for the angle dependent filtering, low impedance resistive summation, and interconnection bus.

The following lists exemplary values for the circuitry components illustrated in FIG. 4:

| | |
|---|---|
| C101 | 22uF |
| C111 | .33uF |
| C112 | .1uF |
| C121 | .33uF |
| C122 | .1uF |
| C131 | .33uF |
| C132 | .1uF |
| C141 | .33uF |
| C142 | .1uF |
| C201 | 22uF |
| C211 | .33uF |
| C212 | .1uF |
| C221 | .33uF |
| C222 | .1uF |
| C231 | .33uF |
| C232 | .1uF |
| C241 | .33uF |
| C242 | .1uF |
| C301 | 22uF |
| C311 | .33uF |
| C312 | .1uF |
| C321 | .33uF |
| C322 | .1uF |
| C331 | .33uF |
| C332 | .1uF |
| C341 | .33uF |
| C342 | .1uF |
| C401 | 22uF |
| C411 | .33uF |
| C412 | .1uF |
| C421 | .33uF |
| C422 | .1uF |
| C431 | .33uF |
| C432 | .1uF |
| C441 | .33uF |
| C442 | .1uF |
| C501 | 22uF |
| C511 | .33uF |
| C512 | .1uF |
| C521 | .33uF |
| C522 | .1uF |
| C531 | .33uF |
| C532 | .1uF |
| C541 | .33uF |
| C542 | .1uF |
| MC110 | MIC_SP0103 |
| MC120 | MIC_SP0103 |
| MC130 | MIC_SP0103 |
| MC140 | MIC_SP0103 |
| MC210 | MIC_SP0103 |
| MC220 | MIC_SP0103 |
| MC230 | MIC_SP0103 |

-continued

| | |
|---|---|
| MC240 | MIC_SP0103 |
| MC310 | MIC_SP0103 |
| MC320 | MIC_SP0103 |
| MC330 | MIC_SP0103 |
| MC340 | MIC_SP0103 |
| MC410 | MIC_SP0103 |
| MC420 | MIC_SP0103 |
| MC430 | MIC_SP0103 |
| MC440 | MIC_SP0103 |
| MC510 | MIC_SP0103 |
| MC520 | MIC_SP0103 |
| MC530 | MIC_SP0103 |
| MC540 | MIC_SP0103 |
| R101 | 1.2K |
| R111 | 562 |
| R121 | 562 |
| R131 | 562 |
| R141 | 562 |
| R201 | 1.2K |
| R211 | 562 |
| R221 | 562 |
| R231 | 562 |
| R241 | 562 |
| R301 | 1.2K |
| R311 | 562 |
| R321 | 562 |
| R331 | 562 |
| R341 | 562 |
| R401 | 1.2K |
| R411 | 562 |
| R421 | 562 |
| R431 | 562 |
| R441 | 562 |
| R501 | 1.2K |
| R511 | 562 |
| R521 | 562 |
| R531 | 562 |
| R541 | 562 |

The particular microphones used in the preferred embodiment are silicon (MEMS) components used primarily in cellular telephones and were manufactured by KNOWLES ELECTRONICS LLC (Itasca, Ill., USA). Other microphones or sensors can be substituted if of appropriately low impedance or if they are electrically buffered so as to make them appear to be of low impedance.

Referring to FIG. 6, the Base Unit 20 acts as the interface between the tile 10 or tile assembly, if more than one tile, and a listener, recorder, transmitter, or other device. Each tile consists of a plurality of microphone elements, 11; ADF and summing components, 12; and the bus, 13 which distributes power to the microphone elements and collects the summed signal. The tiles are connected to the Base Unit, 20 by a single 3 conductor cable, 30 which is attached to only one of the tiles. The Base Unit, 20 provides power, 21 to the tiles; contains the high impedance summing amplifier, 22; filtering, 23 and Automatic Level Control, 24; and amplifies the signal to appropriate levels for listening through headphones, 25, It also provides volume adjustment for the headphones, and outputs line and microphone level audio for recorders, transmitter, and other components or devices.

With test simulations and experiments, the invention provides a high directivity over a broad frequency range. Moreover, with these tests it has been ascertained that the psychoacoustic effects stimulated by the gain peaking and frequency shaping provided by the Angle Dependent Filtering (ADF) assists in steering and isolation (separation) of voices and other sound sources.

The principle of ADF is to use an ac coupled analog summing network into a very high impedance input such as a non-inverting operational amplifier. For optimum effect, the ADF circuit must "see" a very low source impedance in the (electrical) direction of the array of transducers (e.g. microphones) with respect to the value of the summing resistors. The RC (resistance-capacitance) time constant of the coupling capacitors and summing resistors is selected to place the critical frequency (−3 dB) well into the pass band of the system. When terminated with a low or zero impedance to ground, this RC value produces a high pass filter. Because the amplifier input does not provide this low impedance termination, one must look at the other elements of the summing network. When a given source signal arrives at all the transducers of the array at the same time (on axis), all the legs of the summing network are at the same voltage so the effective impedance is infinite and no filtering occurs. This is the same principle as a differential volt meter. When a signal arrives at the array from off-axis, the different time of arrival at the various elements produces a voltage differential. This voltage difference causes each leg of the summing network to act as a shunt impedance by looking back through the source impedance of the transducer section. Because all the other legs act as parallel shunts with respect to any one leg, the total shunt impedance approaches zero and the high pass filter becomes effective.

The high pass filter has the effect of enhancing the physical performance of the array by attenuating off-axis signals for any given size and array aperture. The degree to which this enhancement occurs is dependent on the critical frequency with respect to the desired pass band of the system. Because of the reactive elements (capacitors) in the other legs of the summing network, the attenuation of the filter does not continue as frequency decreases but rather develops a shelving response. In order to mitigate this shelving, a fixed resistive shunt is introduced. The value of this resistance should be substantially greater than each summing resistor so as not to disturb the on-axis frequency response of the array. The exact curve is determined by the interaction of the values of the summing resistors, coupling capacitors, shunt resistor, and the number of summing sources.

The second aspect of ADF is that it alters the frequency response of the system for off-axis signals to a much greater extent than the natural response of the physical array. Just as human vision is more sensitive to changes in color than the intensity of light, human hearing is more sensitive to changes in pitch and frequency response of complex (multi frequency) sounds such as speech than it is to small amplitude changes. The brain uses the change in the character of sounds to distinguish on-axis from off-axis sounds to a much greater degree than the measured amplitude difference. Therefore, the listener is able to extract greater intelligible speech from the on-axis signal.

A third aspect of ADF is that because it introduces a high pass filter for off-axis signals, the summing amplifier needs less high pass filtering to deal with the aperture versus wave length limitation of the physical array. This produces a more natural "high fidelity" response for on-axis signals. Because all on-axis signal sources are received without attenuation, the more natural character allows the listener's brain to distinguish one voice from another when the sound from several talkers arrive together at the array near and on-axis. This increases intelligibility by assists the brain in isolating on a single sound or voice.

Operation

Preferred Embodiment

The manner of using the directional microphone system to listen to remote sound sources is identical to that for parabolic dishes in present use once the system is assembled. The user (listener) simply steers the panel(s) so that the spatial axis that is perpendicular to the plane of the tile(s) is pointed at the targetted sound source. The user then listens through the headphones which are connected to the base unit and makes necessary adjustments to the steering azimuth and elevation so that the desired sound source has the peak response, as determined by listening through the headphones.

Assembly of the system consists first of connecting the tiles together if there are more than one to be included in the array. Each twenty-element tile in the preferred embodiment has a grid of five microphone elements in one direction and four in the other (of course, this might vary in other embodiments). The user decides upon the arrangement of the tiles in the array. Adding more tiles widens the array aperture, so the pattern will be more selective and narrower across all frequencies in the passband. Also, the more elements, the longer the "reach" to distant sounds because there is more signal gain due to collecting and summing more of the on-axis sound. Tiles may be placed in a rectangle or a single row. Odd shaped arrays should be avoided in general as their pick up patterns can be difficult to predict without significant experience or a computer-based simulation.

The tiles may be mounted onto a supporting surface using any aggressive double sided tape or screws through the mounting holes in each tile. If screws are used, the user first cuts a small "X" in the grill cloth to access the mounting holes.

Electrical connection of the tile(s) to the Base Unit is made by soldering the cable # to the three interconnection (jumper) pads on one tile (usually at one edge. An alternate cable may be used containing a transmission ground conductor separate from the shield to improve noise immunity for long cable length.

Figure 5:
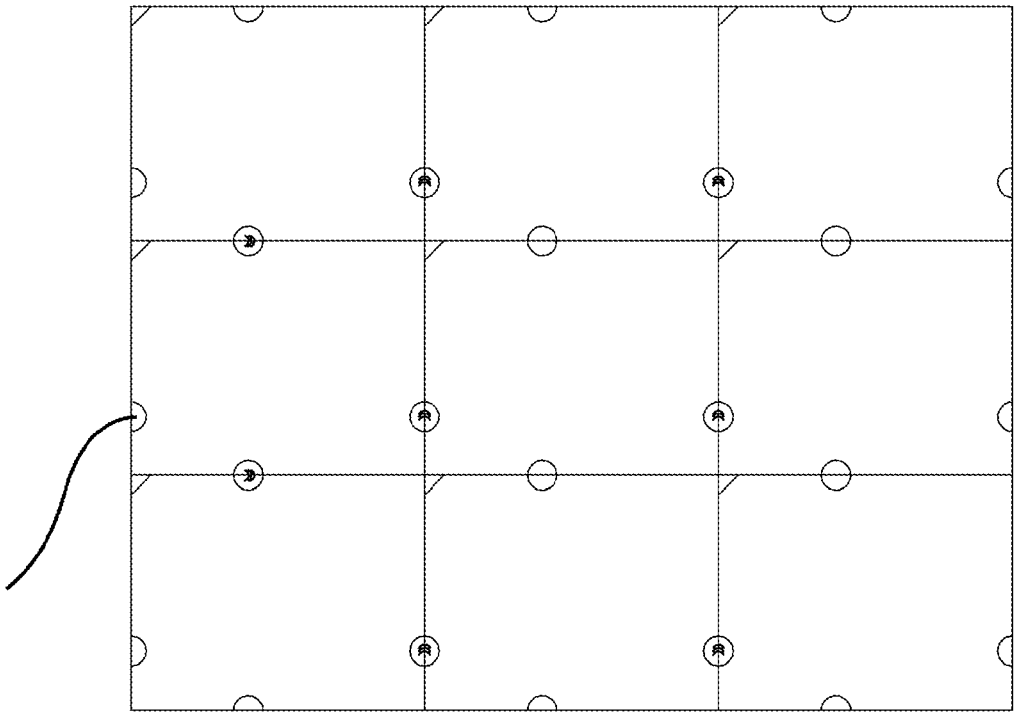
FIG. 5 is an illustration of one embodiment of 9 tiles of 20 microphone elements each arranged in a 3×3 panel.

Electrical connection of the tiles to each other, if more than one is used, is accomplished by using small wires or jumpers to attach adjoining tiles to each other so that every tile is on the bus. These jumpers may either be pushed into the sockets for temporary use or soldered for more reliable long term use. A tree pattern providing the most direct path to the cable for each tile is the best configuration (see FIG. 5).

The Base Unit is battery operated and automatically powered when a plug is inserted into the headphone jack. With a 9 volt alkaline battery (IEC 6LR61) the operating time in hours is calculated with the formula 3200 (60+N) where N is the total number of microphone elements. For a 9 volt lithium battery, the operating time is doubled. Twenty tiles (400 elements) are the maximum that can be powered by a standard 9 volt battery. For very large arrays up to 200 tiles (4000 elements) an alternative battery supply using commercial D cells is used.

The choice of Automatic Level Control (ALC) and Linear (LIN) is selected by a switch inside the Base Unit. ALC is recommended for any multi-source high noise environment; LIN should be used for normal conditions.

Description

Additional Embodiments

The case of modular strips (i.e. lines) of microphones is considered by the inventor to be a simplified case of the preferred embodiment. Plane arrays, such as a grid tile shown as the preferred embodiment, generally have more elements than a comparable size line array and produce directivity on two axes rather than only one axis and therefore the effectiveness of both of the modular (distributed) beamforming and Angle Dependent Filtering is improved by the greater number of elements.

There are various additional possibilities with regard to the selection of microphone. The preferred embodiment uses omni-directional microphones, but uni-directional microphones can also be employed.

There are various additional possibilities with regard to the spacing between and location of the microphones on the modular tiles. For example, the inventor has constructed and tested a single, large tile of approximately 0.6×0.6 meters with a logarithmic spiral arrangement of the microphones.

In the case of multiple interconnected tiles, starburst patterns can be constructed using two different versions of square tiles—one with microphones evenly spaced along one diagonal line of the tile and the other with microphones evenly spaced down the center-line of the tile. Another example of a multiple tile configuration is that of a psuedo-random pattern of microphone locations on each tile. If a tile is designed and populated with a random pattern of microphone locations and spacings, additional tiles of the same design can be connected and their orientation varied up/down and left/right so that the resulting large array will also have a psuedo-random pattern.

Any non uniform spacing of the array elements serves to minimize the alternate cancellation and reinforcement (comb filter effect) of a given frequency from various angles.

There are also additional possibilities to make the invention electronically steered. Fixed or variable delay lines can be inserted in the ADF/Summation circuit to adjust the relative spacing between microphone channels using time delays to replicate physically moving the microphones. The amount of delay between microphones will be dependent upon the spacing between each pair of adjacent microphones and the desired steering direction's azimuth and elevation. This delay could be a fixed delay, which would pre-steer the pick-up pattern in a fixed direction from broadside or it could be a variable delay. This delay could be implemented in analog, digital, surface acoustic wave (SAW), or other technologies.

Although the technology of our modular, scalable array tile is implemented in the preferred embodiment with analog hardware, it is also possible to embed additional analog or digital filtering into the electronic circuitry that would perform other useful functions. An additional embodiment includes a digital decorrelation filter, such as least mean square (LMS) or similar algorithm.

The invention can also be employed as a pre-beamformer on the front end of an analog or digital, fixed or electronically steerable microphone array. The inventor has constructed and tested a plurality of line (strip) tiles that pre-beamform the pick-up pattern in the elevation spatial dimension prior to being fed into individual channels of an electronically steerable analog line beamformer that swept 180 degrees in the azimuth spatial dimension. This allowed the line beamformer to change its effective (net) pick-up pattern's mainlobe from a disk (arc or doughnut shape if the backlobe is not attenuated with sound absorbing material) of greater than 180 degrees into a smaller oval (or cigar) shaped mainlobe. As the strips were short in length, the effect was significant at higher frequencies only. The strips were designed following the modular convention of the preferred embodiment and thus could be connected end-to-end to form longer strips, thereby increasing the effectiveness at lower frequencies.

Finally, there are additional embodiments that involve fusing other sensor data, such as video camera(s) with the sensor array data for purposes of recognition, identification, tracking, steering, or other functions. An example of such an application is a video camera that is added to allow video-based electronic or mechanical (e.g. by a motorized mount or hand operated) steering, with the steering controlled by hand or automatically, such as automatically following a person designated by the user or recognized automatically.

Description

Alternative Embodiments

Although the preferred embodiment exploits the low impedance of silicon (MEMS) microphones to allow low impedance resistive summation, it is possible to implement the invention with higher impedence transducers (such as electret microphones) as long as an appropriate electronic buffer circuit is inserted between the transducers and the ADF/Summation section. This circuit can be as simple as an operational amplifier with an output impedance of approximately 40 ohms or below. This embodiment would not be as cost efficient to manufacture (using current technology) as the preferred embodiment but the ADF/Summation section would function correctly and the other aspects of the invention, aside from temperature performance, still also apply.

There are also alternatives to using microphones as the sensors, such as ultrasonic, accelerometer (vibrational), and even temperature sensors. The invention is applicable to any sensor that can be arrayed and benefit from being generally beamformed to become more directional, summed to lower the over-all internal noise, or modularized (i.e. distributed beamforming).

Figure 7:
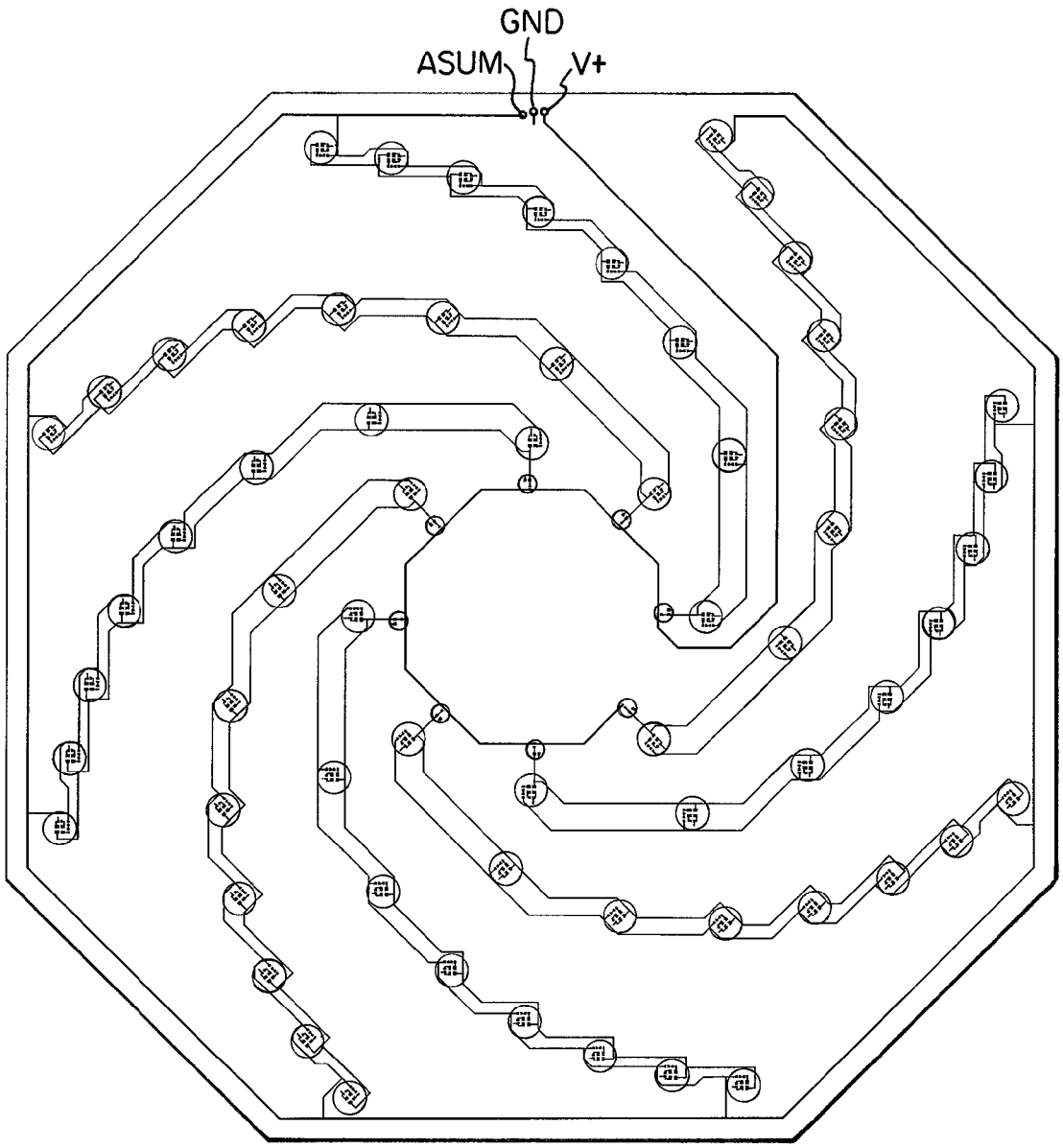
FIG. 7 is an illustration of another embodiment of the invention as a single tile with an alternative microphone arrangement.

There are also alternatives to using line and grid spacings of the sensors on the array. Other structures are possible, such as the logarithmic spiral configuration that we have implemented as another embodiment (see FIG. 7).

CONCLUSION, RAMIFICATIONS, AND SCOPE

The various novel features of the invention, individually or collectively, are a substantial advance in the art of microphone array design and construction. The single cable design makes possible the deployment of arrays which were formerly not practical. The modular construction provides versatility in the field for adapting the array to specific requirements as needed. The low power consumption makes use in mobile, portable, and emplaced field environments much more practical. The inherent RF noise immunity makes operation in electromagnetically harsh environments feasible. The inherent backlobe suppression (from the damping materials and beamforming process) and inter-microphone isolation (from damping material between and on top of the microphones), as well as vibration damping, wind, sand, dust, and moisture resistance make it more robust than prior art and therefore more practical in general and harsh applications.

Angle Depending Filtering enhances the performance of a relatively small array with a large number of elements to perform like a physically larger array. Because it also improves clarity and intelligibility by sound characteristics and not only by attenuation, the acquisition of a desired sound source by steering the array is made easier because the listener can hear the sound from a larger field change as it is brought on-axis.

Additionally, the scalability of the system far exceeds any prior art and significantly expands the potential uses of directional microphone systems in particular and aperture (array) processing in general.

Although the description above contains many specificities, these should not be construed as limiting the scope of the invention but as merely providing illustrations of some of the presently preferred embodiments of this invention. For example, the tiles can have other shapes, such as octagonal; the system can be made electronically steerable, by addition of delay circuitry; the sensors can be mounted on the opposite side of the printed circuit board, by letting the microphone "hear" via a through hole in the PCB; a single tile can have hundreds of sensors, by expanding the ADF/Summation circuitry; a reference microphone can be included as a separate channel from the beamformed signal for noise reduction filtering; multiple tiles or tile assemblies can be used as separate sub-arrays; directional microphone elements can be used instead of the omni-directional ones specified in the preferred embodiment; other types of sensors can be employed, such as accelerometers and ultrasonic transducers; additional noise filtering can be added; a signature recognition function can be added to allow automatic detection, verification, or recognition of sounds, including peoples' voices; a video camera, thermal camera, or other imaging device can be added to assist in steering, detection, inspection, verification, and identification; a pan/tilt mount can be added to provide physical steering of the sensor array; and so forth.

Thus the scope of the invention should be determined by the appended claims and their legal equivalents, rather than by the examples given.

What is claimed is:

1. A sensor array comprising:

(a) a plurality of sensors for receiving acoustic and/or vibrational waves and generating a signal representing information in the waves, (b) electronic circuitry which performs the function of low impedance resistive summation, and (c) a tile having a structure for holding and protecting said sensors, whereby said tile protects said sensors, provides an enlarged means for mounting or directing said sensor array, and provides useful filtering functions on said received waves;

wherein the tile is comprised of:

(a) one or more layers of damping material of predetermined thickness of the same or different densities performing one or more of the functions selected from the group of attenuating vibrations, providing isolation of said sensors from each other, and/or attenuating waves arriving from directions that said sensor array is not steered towards that are received by said sensors, (b) one or more layers of said sensors, (c) a connection and summation bus performing one or more of the functions selected from the group of coupling said sensor array to other electrical devices such as amplifiers and transmitters or coupling said tile to other tiles to form a larger array by electrically summing said information signals, (d) one or more layers of substrate each performing one or more functions selected from the group of mounting said sensors, providing rigidity, providing the shape, providing the interconnecting pads, and/or supporting the weight of the tile, whereby said layers of said tile are sandwiched and held together; and wherein said tile is adapted to detachably connect multiple tiles together to form a larger sensor array; and wherein beamforming is performed on said larger array of multiple tiles.

2. The sensor array of claim 1 wherein said electronic circuitry is coupled to the sensors and performs one or more of the functions selected from the group of providing directionality to said sensor array's pick up pattern or reducing internal noise, whereby said electronic circuitry acting as part of the sensor array performs enhancement on said signal information caused by waves emanating from the direction that said sensor array is steered, performs reduction on undesired portions of said signal information caused by waves emanating from directions other than where the sensor array is steered, and performs reduction on internal noise, said internal noise comprising thermal noises in the sensors and/or electronic circuitry.

3. The sensor array of claim 1 wherein said tile is covered by a protective material performing the function selected from the group of protecting said sensors from wind induced noise, and/or protecting said sensors from damage by wind, sand, dust, or moisture while at the same time permitting said waves to be received by the sensors, whereby said protective material allows said sensor array to be handled by the user.

4. The sensor array of claim 1 wherein said sensors are microphones, whereby said sensor array using said microphones allows distant or weak sound sources to be heard by the user or listener while reducing sounds from directions other than where steered.

5. The sensor array of claim 4 wherein the microphones are spaced at uniform or non uniform distances from each other on the same line or plane.

6. The sensor array of claim 1 wherein the electronic circuitry also contains fixed or changeable time delay filter circuitry to allow electronic steering of said sensor array's pick up pattern or direction of steering.

7. The sensory array of claim 1 wherein said sensors are ultrasonic sensors.

8. The sensory array of claim 1 wherein the electronic circuitry includes additional functionality that selectively filters said signal information based upon the angle that said waves, from which said signal information was generated, arrive at the sensors, whereby said selective filtering allows the user to more easily distinguish between waves arriving from the direction said sensor array is steered towards and waves arriving from other directions, and also allows the user to determine when said sensor array is steered directly toward a desired wave source.

9. The sensory array of claim 1 further comprising another tile, wherein the tiles are connected with each other to create a larger array.

10. The sensory array of claim 9 wherein a plurality of tiles are arranged in a line or in the shape of a rectangle.

* * * * *